US007233110B2

(12) United States Patent
Uemura et al.

(10) Patent No.: US 7,233,110 B2
(45) Date of Patent: Jun. 19, 2007

(54) METAL HALIDE LAMP AND LIGHTING DEVICE

(75) Inventors: Kozo Uemura, Yokosuka (JP); Hiromichi Kawashima, Yokosuka (JP)

(73) Assignee: Harison Toshiba Lighting Corp., Ehime-ken (JP)

( * ) Notice: Subject to any disclaimer, the term of this patent is extended or adjusted under 35 U.S.C. 154(b) by 0 days.

(21) Appl. No.: 10/963,215

(22) Filed: Oct. 12, 2004

(65) Prior Publication Data

US 2005/0082987 A1 Apr. 21, 2005

(30) Foreign Application Priority Data

Oct. 20, 2003 (JP) ..... 2003-358935

(51) Int. Cl.
*H01J 17/20* (2006.01)
*H01J 61/12* (2006.01)

(52) U.S. Cl. ..... 313/637; 313/638; 313/640

(58) Field of Classification Search ..... 313/637, 313/638, 640
See application file for complete search history.

(56) References Cited

U.S. PATENT DOCUMENTS 6,353,289 B1 * 3/2002 Ishigami et al. ..... 313/637
2002/0158580 A1 * 10/2002 Uemura et al. ..... 313/643

FOREIGN PATENT DOCUMENTS

| | | |
|---|---|---|
| EP | 1154455 A2 | 11/2001 |
| EP | 1339090 A1 | 8/2003 |
| JP | 11238488 | 8/1999 |

OTHER PUBLICATIONS

Feb. 2, 2005 official Communication and European Search Report in connection with corresponding European Patent Appl. No. EP 04 25 6942 (Exhibit B).

* cited by examiner

*Primary Examiner*—Mariceli Santiago
(74) *Attorney, Agent, or Firm*—John P. White; Cooper & Dunham LLP

(57) ABSTRACT

A metal halide lamp comprises a refractory, light-transmitting airtight container defining therein a discharge space with an internal volume of not more than 0.1 cc, electrodes sealed in the container, opposing each other with a distance of not more than 5 mm interposed, and a discharge medium sealed in the container and including a metal halide material and a rare gas. The metal halide includes first and second halide materials. The first halide material contains scandium (Sc) and sodium (Na) halides. The second halide material contains at least one of indium (In) and zinc (Zn) halides. The discharge medium contains substantially no mercury. The load on the wall of the container in a stable state is 50 W/cm$^2$ or more. A/B≦0.21 where A represents the intensity of an impurity chromium (Cr) spectrum in lighting spectra, and B represents the intensity of a scandium (Sc) spectrum.

12 Claims, 4 Drawing Sheets

METAL HALIDE LAMP AND LIGHTING DEVICE

CROSS-REFERENCE TO RELATED APPLICATIONS

This application is based upon and claims the benefit of priority from prior Japanese Patent Application No. 2003-358935, filed Oct. 20, 2003, the entire contents of which are incorporated herein by reference.

BACKGROUND OF THE INVENTION

1. Field of the Invention

The present invention relates to a metal halide lamp with no mercury sealed therein and a lighting device using this lamp.

2. Description of the Related Art

In high-pressure discharge lamps, a pair of electrodes are sealed in a discharge space defined in a light-transmitting, airtight container made of refractory materials, and a discharge medium using a metal vapor as a main component is sealed in the container. Such electrodes generally have a structure wherein: Their proximal ends are welded to respective metal leaves airtightly buried in a pair of slim sealing portions formed integral with the opposite ends of the airtight container. Their intermediate portions are loosely supported by the respective sealing portions. Further, their distal ends, i.e., electrode main portions, protrude into the discharge space.

High-pressure discharge lamps are used for various purposes. Among them, compact high-pressure discharge lamps of a high output used in, for example, vehicle headlights are characterized in that their airtight container has a small internal volume, the pressure of the discharge medium is high during lighting, and the operating temperature is high. Therefore, the influence of impurities discharged from their structural components mounted on or sealed in the airtight container upon the long-term brightness or life of the lamps is relatively high.

Furthermore, in the high-pressure discharge lamps for vehicle headlights, the luminous power. 1.5 output immediately after ignition is lower than a predetermined value. To compensate for this, power several times higher than in a stable state is supplied at the start of lighting. More specifically, immediately after ignition, a lamp current several times larger than in the stable state is produced between the electrodes, thereby accelerating increase in luminous power to promptly activate the high-pressure lamp. At the same time, the lamp is controlled to be promptly stabilized.

On the other hand, high-pressure discharge lamps with an internal volume of 0.1 cc or less, which are used as metal halide lamps for vehicle headlights or spot lights, generally have a structure in which a rare gas, halides of light-emitting metals and mercury are sealed in a light emission tube with a pair of opposing electrodes. These high-pressure discharge lamps exhibit a relatively high efficiency and a high color-rendering characteristic. Therefore, they are widely used. However, at the present stage at which environmental problems have become serious, it has become significantly important also in the field of lighting devices to reduce or stop the use of mercury whose environmental impact is high. To this end, various proposals have been made for eliminating mercury from metal halide lamps. For example, Jpn. Pat. Appln. KOKAI Publication No. 11-238488 discloses a technique for adding, instead of mercury, a material having a high vapor pressure, such as $ZnI_2$, to a light-emitting halide material, such as $ScI_3$—NaI, thereby acquiring the same electric characteristic and light emission characteristic as those acquired from a mercury-containing lamp.

However, metal halide lamps without mercury cannot provide the advantage of thickening a discharge arc, obtained when the light emitted from mercury atoms is absorbed by the atoms themselves. Therefore, the resultant discharge arc is inevitably thin. The thickness (width) of a discharge arc influences the design of optical systems, and hence it is stipulated in regulations (e.g., EU Regulation No. 99 and Japan Electric Lamp Manufacturers Association Regulation JEL 215 "Vehicle Headlight HID Light Source"). If the arc is thin, it departs from the regulation.

The inventor of the present invention has found that when chromium (Cr), an impurity, exists in the airtight container, it emits light and thins the discharge arc, and that the discharge arc can have a thickness satisfying the regulation if the emission spectrum of chromium is kept at a predetermined value or less. The present invention has been developed based on this finding.

BRIEF SUMMARY OF THE INVENTION

It is an object of the invention to provide a metal halide lamp having its arc width improved without sealing mercury therein, which is suitable, in particular, for a vehicle headlight, and to provide a lighting device using this lamp.

In accordance with an aspect of the invention, there is provided a metal halide lamp comprising: a refractory, light-transmitting airtight container defining therein a discharge space with an internal volume of not more than 0.1 cc; a pair of electrodes sealed in the airtight container, opposing each other with a distance of not more than 5 mm therebetween; and a discharge medium sealed in the airtight container and including a metal halide material and a rare gas, the metal halide material including a first halide material and a second halide material, the first halide material containing a scandium (Sc) halide and a sodium (Na) halide, the second halide material containing at least one selected from the group consisting of an indium (In) halide and a zinc (Zn) halide, the discharge medium containing substantially no mercury, wherein a load on a wall of the airtight container in a stable state is not less than 50 $W/cm^2$; and $A/B \leqq 0.21$ where A represents an intensity of an impurity chromium (Cr) spectrum included in lighting spectra, and B represents an intensity of a scandium (Sc) spectrum included in the lighting spectra.

In the above-described invention and each invention described below, the terms used have the following definitions and technical meanings if they are not particularly designated:

Airtight Container: The airtight container is refractory and light-transmittable. "Refractory" means that the container is strong enough to resist the standard operation temperature of discharge lamps. Accordingly, the airtight container may be formed of any material if the material is refractory and can transmit, to the outside thereof, visible light of a desired wavelength area generated by discharge. For example, it may be quartz glass or, polycrystal or monocrystal ceramics such as light-transmitting alumina, YAG. However, in the case of metal halide lamps for vehicle headlights, quartz glass having a high direct transmittance is appropriate since a high light-concentration efficiency is required. When necessary, it is allowed to form, on the inner surface of the airtight container of quartz glass, a light-transmitting film having a resistance against halogens or halides, or to improve the quality of the inner surface of the airtight container.

Further, the airtight container defines therein a discharge space having an internal volume of 0.1 cc or less, preferably, 0.05 cc or less. Preferably, the discharge space is a substantial cylinder that has an inner diameter of 1.5 to 3.5 mm and an axial length of 5 to 9 mm. By virtue of this shape, in horizontal lighting, the arc is liable to warp upwards and approach the inner surface of the upper portion of the airtight container, which accelerates the increase of the temperature of the upper portion.

Furthermore, the portion surrounding the discharge space can be made relatively thick. In other words, the portion located at substantially the intermediate position between the electrodes can be made thicker than the opposite ends. As a result, the heat transmittance of the airtight container is increased to thereby accelerate the temperature increase of the discharge medium stuck to the inner surfaces of the lower and side portions of the container, with the result that the rise of a luminous flux is accelerated.

In addition, to seal the electrodes, described later, the airtight container can be formed integrally as one body with a pair of cylindrical sealing sections so that the sealing sections are located at the respective axially opposite ends of the discharge space. Preferably, using a reduced-pressure sealing method, or using both the reduced-pressure sealing method and pinch sealing method, the electrodes are connected to external guide wires via the airtightly buried metal leaves. As a result, a current can be supplied to the electrodes, and the closing section can be formed without an exhaustion tip, thereby avoiding disturbance of the light distribution characteristic due to the exhaustion tip.

Electrodes: The pair of electrodes are sealed in the airtight container, opposing each other with a distance of 0.5 mm or less interposed therebetween. Preferably, the electrodes have a linear axial portion having substantially the same diameter in the longitudinal direction. The diameter of the axial portion is, preferably, 0.3 mm or more, and 0.45 mm or less preferably as a metal halide lamp for vehicle headlights. The diameter of the axial portion is substantially constant. The distal end of each electrode is formed flat, or has a curved surface serving as the starting point of an arc. Alternatively, the distal end may be formed to a larger diameter than the axial portion. When the diameter of the axial portion is made substantially constant, and the distal end has a curved surface as the starting point of an arc, the curved surface is substantially spherical. If the radius of the curved portion is made ½ or less the diameter of the axial portion, an undesired shift of the starting point of an arc can be suppressed, thereby reducing the degree of flicker of the arc. The term "distal end as the starting point of an arc" means the portion as the starting point of an arc, and does not always mean the entire geometrical configuration of the distal end of an electrode. It is sufficient if the distal end, serving as the starting point of an arc, has a curved portion with a radius ½ or less the diameter of the axial portion of the electrode. Preferably, the curved portion, serving as the starting point of an arc, has a radius of 40% or more of ½ the diameter of the axial portion.

Furthermore, the length of the portion of each electrode projecting into the discharge space influences the electrode temperature, as well as the diameter of the axial portion. However, it is sufficient if the length is set to a standard value for small metal halide lamps of this type, i.e., set to, for example, 1.4±0.1 mm. The electrodes may be powered by either an alternating current or direct current. When they are powered by an alternating current, they are made to have the same structure. When they are powered by a direct current, the anode must be formed larger in diameter than the cathode to increase its heat dissipation area, since the temperature increase of the anode is larger than that of the cathode. This structure exhibits a higher resistance against frequent turn-on and turn-off.

In addition, the electrodes can be formed of pure tungsten (W), doped tungsten, rhenium (Re) or a tungsten-rhenium alloy (W—Re), etc. Further, to seal the electrodes in the airtight container, the proximal ends of the electrodes can be buried and supported in the sealing sections of the airtight container. Specifically, the proximal ends of the electrodes are coupled, by, for example, welding, to respective sealed metal leaves of, for example, molybdenum (Mo) airtightly buried in the sealing sections.

Discharge Medium: The discharge medium contains a metal halide material and a rare gas, but almost no mercury. The metal halide material contains first and second halide materials.

The first halide material includes a scandium (Sc) halide and a sodium (Na) halide. These metals are main light emission metals that emit white light efficiently. However, if necessary, a rare-earth metal, such as Dy, may be added as a light emission metal to the first halide material.

The second halide material includes at least one selected from the group consisting of an indium (In) halide and a zinc (Zn) halide. These metals are lamp-voltage-forming mediums mainly used instead of mercury (Hg). However, these metals emit blue glow, which corrects the chromaticity of the white light emitted from the main emission materials of the first metal halide material. The indium (In) halide is, specifically, InI, $InI_3$ or InBr, and any one of these may be used.

Further, along with the second halide material, a metal halide (or halides) selected from the group recited below can be accessorily added as a lamp-voltage-forming medium. If one or several halides of metals selected from the group consisting of magnesium (Mg), cobalt (Co), manganese (Mn), antimony (Sb) rhenium (Re), gallium (Ga), tin (Sn), iron (Fe), aluminum (Al), titanium (Ti), zirconium (Zr) and hafnium (Hf) are added, the lamp voltage can be adjusted. The metals included in the above group are appropriate mainly for forming a lamp voltage, although their vapor pressure is high and do not emit visible light, or they emit only a small amount of light, i.e., they are not expected as light emission metals.

The use of the second halide material and/or metal halides as auxiliary lamp-voltage forming mediums enables a lamp voltage of 25 to 70V to be generated without using mercury even in a small metal halide lamp according to the present invention. Therefore, a desired lamp voltage can be acquired even when a relatively small lamp current is supplied.

A description will now be given of lighting spectra conditions. The present invention has been developed in light of the knowledge that impurities existing in the discharge space narrow the width of a discharge arc. Further, the inventor of the present invention has found that among the impurities, chromium (Cr), in particular, significantly influences the width of a discharge arc, i.e., that when impurity chromium (Cr) exists in the discharge space, the discharge arc is thinned. In other words, if the amount of chromium is reduced, the discharge arc is prevented from being thinned. In the present invention, the condition, $A/B \leqq 0.21$, is a requirement, where A represents the intensity of an impurity chromium (Cr) spectrum of 428.9 nm in lighting spectra, and B represents the intensity of a scandium (Sc) spectrum of 393.4 nm. Since A/B is substantially proportional to the width of a discharge arc, the discharge arc is relatively thick even if A/B is slightly higher than 0.21. However, the discharge arc should be as thick as possible. Because of this, the condition A/B≦0.21 is used as a requirement of the invention.

If A/B≦0.21, an arc width of 0.85 mm or more, stipulated in EU Regulation No. 99, is acquired, and the light emitted from the lamp can be distributed in good conditions.

Halogens included in halides will be described. Concerning reactivity, iodine is most appropriate, and iodides are sealed at least as the light emission metals. When necessary, however, different halides including, for example, iodides and bromides, may be contained.

The rare gas serves as a starting gas and buffer gas, and comprises at least one selected from argon (Ar), krypton (Kr), xenon (Xe), etc. Further, as a metal halide lamp for vehicle headlights, xenon of 5 atoms or more, preferably, 8 to 16 atoms is sealed, or xenon is sealed so that the pressure in the discharge space during lighting is kept at 50 atoms or more. As a result, when the vapor pressure of the light emission metals is low immediately after the ignition of the lamp, the white light emitted from xenon can be used as a luminous flux.

Mercury (Hg) will also be described. In the invention, the feature that the discharge medium contains substantially no mercury means not only that no mercury is contained, but also that the existence of mercury of less than 2 mg, preferably, 1 mg or less, per internal volume of 1 cc is allowed. Of course, it is desirable for the environment to contain no mercury. However, that allowance is very near to zero, compared to the conventional cases where mercury of 20 to 40 mg, 50 mg or more in some cases, is contained per internal volume of 1 cc of a short-arc type airtight container to increase the lamp voltage to a required value using mercury vapor.

Load on Bulb Wall Defining Discharge Space:

To acquire light emission of a desired luminous flux and chromaticity, a load of 50 W/cm$^2$ or more must be applied to the bulb wall that defines the discharge space, when the metal halide lamp is in a stable lighting state. By virtue of the load, the vapor pressure of the first and second halide materials is increased to provide desired light emission. Preferably, the load is 55 to 70 W/cm$^2$. For a small metal halide lamp incorporating an airtight container with an internal volume of 0.1 cc or less, it is preferable to set the lamp power to 65 W or less in the stable lighting state. The bulb wall load means lamp power (W) per inner area of 1 cm$^2$ of the discharge space defined in the airtight container.

Function of the Invention

By virtue of the above-described structure, a desired lamp voltage can be acquired from a relatively small lamp current without using mercury vapor, but mainly using a zinc (Zn) halide and/or an indium (In) halide to increase the lamp voltage.

Further, if the condition, A/B≦0.21, is satisfied, A representing an intensity of an impurity chromium (Cr) spectrum included in lighting spectra, and B representing an intensity of a scandium (Sc) spectrum included in the lighting spectra, the thinning of a discharge arc can be suppressed. The thickness (width) of the discharge arc is measured using the international regulation, E/ECE/324, E/ECE/TRANS/505} Rev. 1/Add. 98. Regulation No. 98, Page 20, annex 1.

Other Structures of the Invention: If the following structures, which are not essential requirements of the invention, are selectively added, 1:5 the performance of the metal halide lamp is enhanced and/or the functions of the lamp are increased.

1. Outer Tube: The outer tube houses the airtight container. It prevents ultraviolet rays from being emitted to the outside of the airtight container, protects the airtight container from drying, and mechanically protects the airtight container. Further, to adjust the light distribution characteristic, a light-shading film can be attached to the outer tube. The interior of the outer tube may be airtightly sealed, or contain air or inactive gas of the same pressure as the atmospheric pressure or of a reduced-pressure, depending upon the purpose. Further, if necessary, the interior of the outer tube may communicate with the external air.

2. Metal Cap: The metal cap is used to connect the metal halide lamp to the lighting circuit, and to mechanically support the lamp.

3. Igniter: The igniter is means for generating a high-voltage pulse voltage, and applying it to the metal halide lamp to accelerate the start of the metal halide lamp. The igniter can be coupled to the metal halide lamp if, for example, it is housed in the metal cap.

4. Start Aiding Conductor: The start aiding conductor is means for increasing the intensity of the electric field near the electrodes to aide the start of the metal halide lamp. If necessary, one end of the conductor is connected to the portion of the same potential as one electrode, and the other end is provided on the outer surface of the discharge bulb near the other electrode.

In accordance with another aspect of the invention, there is provided a lighting device comprising: a lighting device main unit; the metal halide lamp, specified in the above, incorporated in the lighting device main unit; and a lighting device configured to light the metal halide lamp.

In the invention, "lighting device" has a broad concept including all devices using the metal halide lamp as a light source, such as a vehicle headlight, lighting instrument, blinker, beacon light, optical fiber lighting device, photochemical reaction device, etc. "Lighting device main unit" means the remaining portions of the lighting device excluding the metal halide lamp and lighting circuit.

The lighting circuit is means for lighting the metal halide lamp. Preferably, it is a digital circuit. However, if necessary, the lighting circuit may be mainly formed of a coil and iron core. Further, in the lighting circuit for vehicle headlights, if the maximum power supplied within four seconds after ignition of the metal halide lamp is set to 2 to 4 times, preferably, 2.5 to 4 times, the lamp power in a stable state, the luminous flux can quickly rise to fall within an intensity range necessary for vehicle headlights. Assume here that the pressure of xenon sealed as a rare gas in the airtight container is represented by X (atoms) falling within a range of 5 to 15 atoms, and the maximum power supplied within the four seconds after ignition of the metal halide lamp is represented by AA (W). In this case, if AA satisfies the following formula, within the four seconds after ignition of the metal halide lamp, the luminous flux can quickly rise, and a luminous intensity of 8000 cd at a representing point of the front surface of a vehicle headlight, necessary for vehicle headlights, can be acquired:

$$AA > -2.5X + 102.5$$

The reason why the pressure of sealed xenon and the maximum input power have a linear relationship is that xenon is a discharge medium of a low vapor pressure, and the light emitted from xenon is prevailing within the four seconds after ignition of the metal halide lamp. Since the luminous energy of xenon is determined from the pressure of xenon and power applied thereto, if the pressure of xenon is low, the input power should be increased, whereas if the pressure is high, the input power should be reduced. In the invention, the metal halide lamp may be lit using either an alternating current or direct current.

Furthermore, when necessary, the lighting circuit can be constructed such that the no-load output voltage is set to 200V or less. Since, in general, a metal halide lamp with no mercury contained therein requires a lower lamp voltage than that with mercury, the no-load output voltage can be set to 200V or less. This being so, the lighting circuit can be made compact.

DETAILED DESCRIPTION OF THE INVENTION

Figure 1:
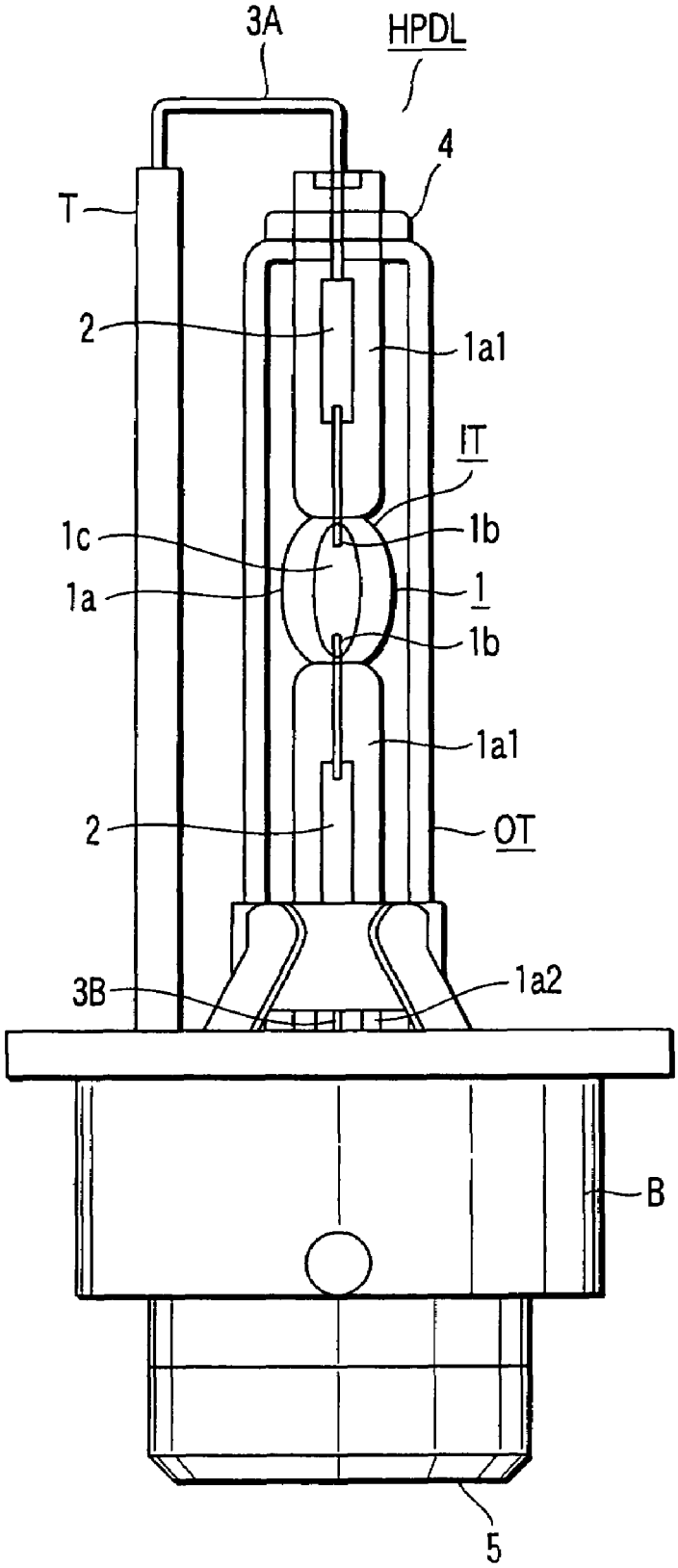
FIG. 1 is a front view illustrating the entire metal halide lamp for vehicle headlights, according to an embodiment of the invention.
Figure 2:
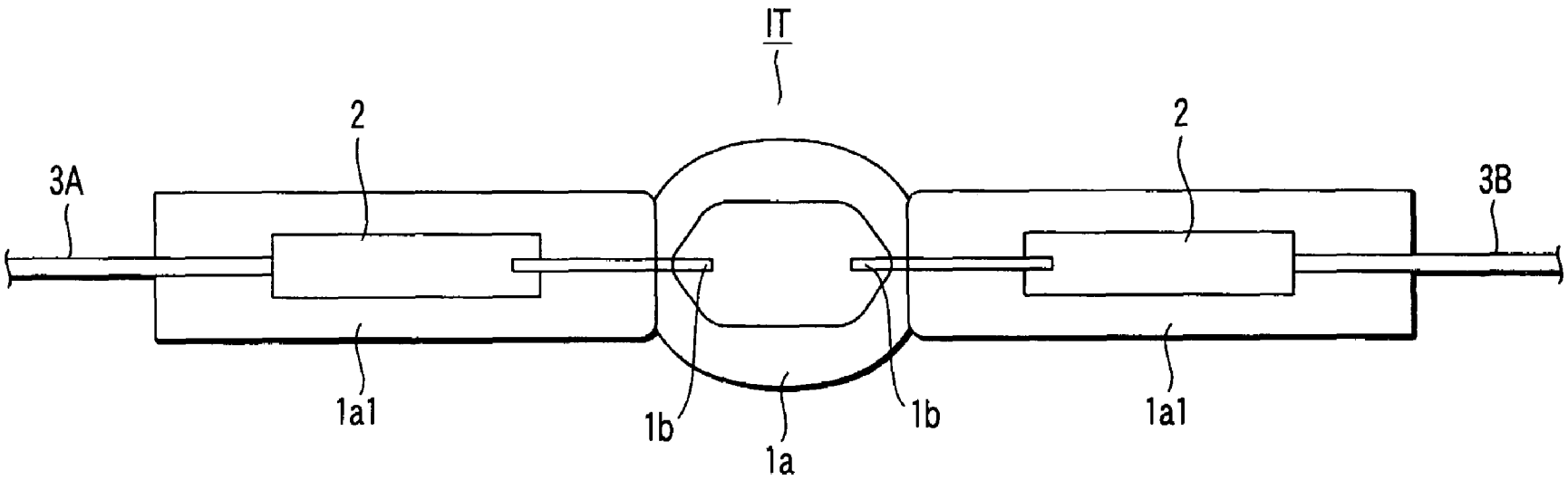
FIG. 2 is an enlarged front view illustrating an essential part of the light-emitting tube of the halide lamp.
Figure 3:
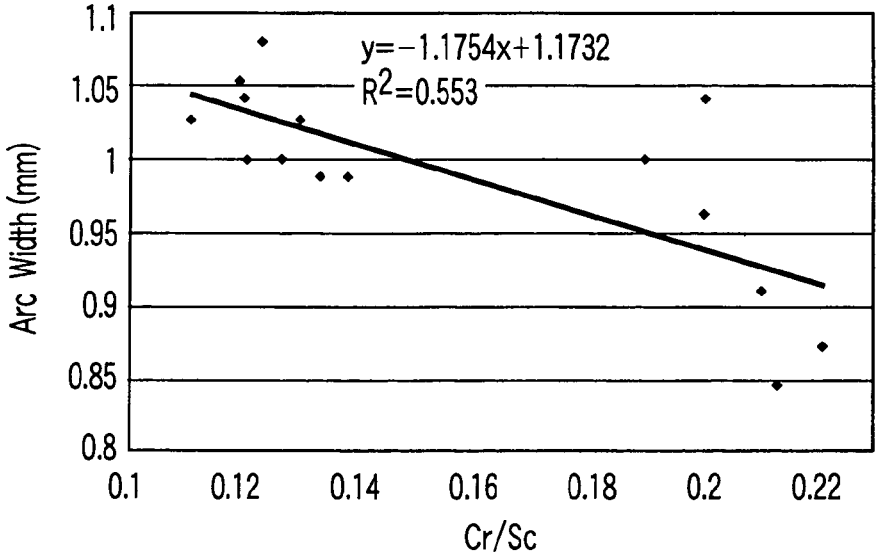
FIG. 3 is a graph illustrating the relationship between the arc width of discharge and the ratio of the chromium (Cr) spectrum to the scandium (Sc) spectrum included in the lighting spectra of a metal halide lamp.

FIGS. 1 and 2 show a metal halide lamp for vehicle headlights according to an embodiment of the invention. More specifically, FIG. 1 is a front view illustrating the entire lamp. FIG. 2 is an enlarged front view illustrating an essential part of the light emission tube of the halide lamp. FIG. 3 is a graph illustrating the relationship between the arc width of discharge and the ratio of the chromium (Cr) spectrum to the scandium (Sc) spectrum included in the lighting spectra of a metal halide lamp. In this embodiment, a high-pressure discharge lamp HPDL comprises a light emission tube IT, insulation tube T, outer tube OT and a metal cap B.

The light emission tube IT includes an airtight container 1, a pair of electrodes 1*b*, a pair of sealed metal leaves 2, a pair of external lead wires 3A and 3B and a discharge medium.

The airtight container 1 includes a closing section 1*a* and a pair of sealing sections 1*a*1. The closing section 1*a* is a hollow member of a spindle shape. The closing section 1*a* has its opposite ends provided with the slim sealing sections 1*a*1 formed integrally therewith as one body, and has a slim and substantially cylindrical discharge space 1*c*. The internal volume of the discharge space 1*c* is 0.1 cc or less.

The proximal ends of the electrodes 1*b* are welded, by a laser, to respective ends of the sealed metal leaves 2, described later, buried in the respective sealing sections 1*a*1. The intermediate portions of the electrodes 1*b* are buried in the respective sealing sections 1*a*1, loosely supported at predetermined positions. The distal ends of the metal leaves 2 project into the discharge space 1*c*, opposing each other from the opposite ends of the space.

The sealed metal leaves 2 are molybdenum (Mo) leaves airtightly buried in the respective sealing sections 1*a*1 of the airtight container 1.

The external lead wires (current guiding members) 3A and 3B have their distal ends welded to the other ends of the sealed metal leaves 2 in the sealing sections 1*a*1 of the airtight container 1, and have their proximal ends lead to the outside of the respective sealing sections 1*a*1. The current guiding member 3B, lead to the right in FIG. 2 from the discharge (light emission) tube IT, has its intermediate portion folded along the outer tube OT, described later. The member 3B is then guided into a metal cap B, described later, and connected to one metal cap terminal 5. The current guiding member 3A, lead to the left in FIG. 2 from the discharge tube IT along the axis of the container, is extended along the axis, guided into the metal cap B and connected to the other metal cap terminal (not shown).

The closing section 1*a* of the airtight container 1 seals therein a discharge medium formed of first and second halides and a rare gas. The first halide comprises a scandium (Sc) halide and sodium (Na) halide. Further, the second halide comprises at least an indium (In) halide and/or zinc (Zn) halide.

A description will be given of a procedure example for assembling the discharge tube IT constructed as above. Firstly, the closing section 1*a* and a pair of sealing tubes connected to the opposite ends of the section 1*a* are formed integral as one body. At the same time, electrode mounts each including the corresponding electrode 1*b*, to-be-sealed metal leaf 2 and external lead wire 3A (or 3B) formed integral with each other as one body by welding are prepared. Subsequently, one of the sealing tubes of the airtight container 1 is directed upward, and one of the electrode mounts is inserted into the sealing tube to a predetermined position. After that, the sealing tube is softened by heating from the outside, and sealed by, for example, reduced-pressure sealing. As a result, the to-be-sealed metal leaf 2 of one of the electrode mounts is airtightly buried in the sealing section 1*a*1 formed by crushing the sealing tube, the electrode 1*b* is sealed at a predetermined position, and the external lead wire 3A is guided to the outside of the sealing section 1*a*1. Thereafter, the airtight container 1 is turned upside down in the atmosphere of a rare gas to direct the other sealing tube upward, and the first and second halides are sealed in the container 1 from the other sealing tube, and the other electrode mount is inserted into the other sealing tube. In this state, while cooling the end of the closing section connected to the previously sealed tube, the other sealing tube is heated, softened and sealed by, for example, reduced-pressure sealing. As a result, the to-be-sealed metal leaf 2 of the other electrode mount is airtightly buried in the other sealing section 1*a*1 formed by crushing the other sealing tube, the other electrode 1*b* is sealed at a predetermined position, and the external lead wire 3B is guided to the outside of the sealing section 1*a*1. In the above-described assemblage process, it is important to very carefully carry out the process so as not to mix an impurity, in particular, chromium (Cr), into the airtight container 1.

To reduce the mixture of chromium (Cr) in the above process, it is advisable to make the process proceed, for example, in the following manners:

1. To prevent a metal containing Cr, typically stainless (hereinafter referred to as "SUS"), from being touched during the storage of the materials of electrode mount components, such as electrodes, Mo leaves, welds, etc., during the assemblage of the electrode mounts, during the transfer of electrode mount finished products, and during the lamp manufacturing process of, for example, inserting the products into a quartz bulb.

Specifically, the inner surface of the material storage should not be formed of SUS. During assembling the mounts, the portion of the assembly jig used to hold or fix each mount material, which directly touches each mount material, should not be formed of SUS. During the manufacture of a lamp, the jig used to catch and hold the assembled mounts should not formed of SUS, and the hold/insertion jig used to insert the mounts into a mold bulb of quartz should not be formed of SUS.

The above consideration contributes to reduction of attachment of Cr to the electrode mounts when they are treated.

2. The inner wall of a heating furnace used for heating the electrode mounts should not be formed of SUS.

Specifically, when heating the electrode mount components, such as electrodes, Mo leaves, welds, etc., and the assembled electrode mounts, the innermost wall of furnaces used should not be formed of SUS. The furnaces include a high-temperature vacuum treatment furnace, hydrogen-reduced treatment furnace, anneal furnace, electrode treatment high-temperature furnace, etc.

The above consideration contributes to reduction of attachment of Cr to the electrode mounts due to scattering of a SUS component during heating in the furnaces.

3. During the manufacture of the materials of the electrodes, Mo leaves and welds, they are prevented from being touched by SUS.

This consideration contributes to reduction of Cr mixture due to SUS mixture during the manufacture of the materials.

4. During molding a bulb, bulb quartz is prevented from being touched by SUS.

This consideration contributes to reduction of Cr mixture due to SUS mixture caused by a holder jig of SUS or a mold of SUS during molding the bulb.

5. A structure is employed in which a container containing to-be-sealed chemicals, and a chemical charger are prevented from being touched by SUS.

This consideration contributes to reduction of Cr mixture due to SUS mixture that occurs during handling the chemicals.

The outer tube OT, which contains the discharge tube IT, has an ultraviolet-ray cutting function. The outer tube OT has a small diameter portion 6 located at its distal end and welded to the sealing section 1*a*1 by glass at the shown position. Further, the other small-diameter portion (not shown) is welded to a sealing tube 1*a*2 by glass. The outer tube OT is not airtight but communicates with the outside air.

The insulation tube T covers the current guiding member 3B.

The metal cap B is a standardized one as a component of a metal halide lamp for vehicle headlights, and is constructed such that it extends coaxial with the discharge tube IT and outer tube OT, and can be mounted on and dismounted from the back surface of a vehicle headlight. Further, the metal cap B includes a support band 4 extending from the front surface thereof along the axis of the lamp and covering the proximal end of the outer tube OT.

Embodiment

The embodiment of the invention shown in FIGS. 1 and 2 satisfies the following conditions:

Light emission tube IT

In airtight container 1*a*, material: quartz glass; internal volume: 0.025 cc; closing section maximum inner diameter: 2.6 mm; discharge space maximum length: 6.7 mm; maximum outer diameter: 6.0 mm In electrode 1*b*, material: doped tungsten; diameter: 0.32 mm; inter-electrode distance: 4.2 mm;

Discharge medium

Metal halide material: NaI—$ScI_3$—InBr—$ZnI_2$=0.3 mg

Rare gas: Xenon of 11 atoms

Outer tube OT

Outer diameter: 9 mm; inner diameter: 7 mm; inner atmosphere: atmospheric pressure during lighting Power immediately after turn-on: 85 W Current immediately after turn-on: 2.8 A Lamp voltage in stable state: 42V Lamp current in stable state: 0.8 A Lamp power in stable state: 35 W Arc width: 1.05 mm.

Referring now to FIG. 3, a description will be given of search results concerning the relationship between the arc width of discharge and the intensity ratio of a chromium (Cr) spectrum of 428.9 nm to a scandium (Sc) spectrum of 393.4 nm included in the lighting spectra. In FIG. 3, the abscissa indicates the intensity ratio (Cr/Sc) of the chromium (Cr) spectrum to the scandium (Sc) spectrum included in the lighting spectra. The ordinate indicates the arc width (mm). In the figure, mark ♦ indicates measured data acquired from a number of samples, and the solid line is acquired from the measured data.

As can be understood from FIG. 3, an apparent correlation can be detected between the intensity ratio of the chromium (Cr) spectrum to the scandium (Sc) spectrum and the discharge arc width. If Cr/Sc is 0.21 or less, the discharge arc width sufficiently satisfies the standard.

Figure 4:
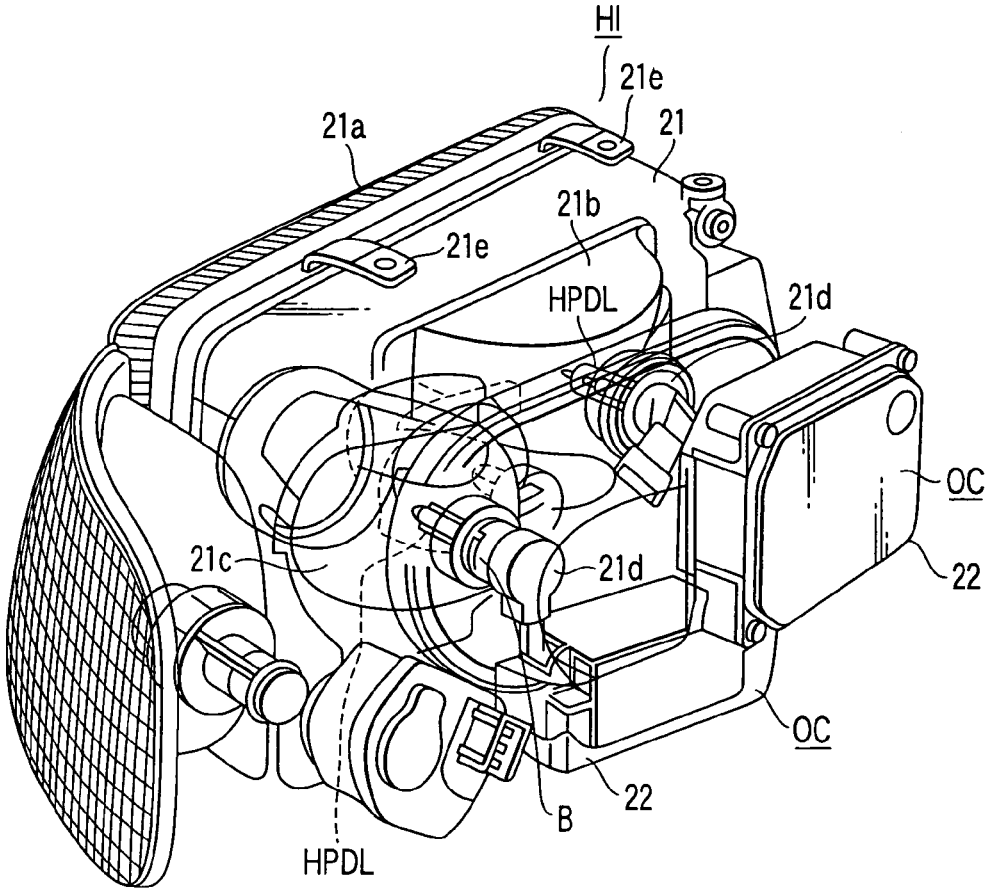
FIG. 4 is a perspective view, taken from the back, of a vehicle headlight to which the lighting device of the invention is applied.
Figure 5:
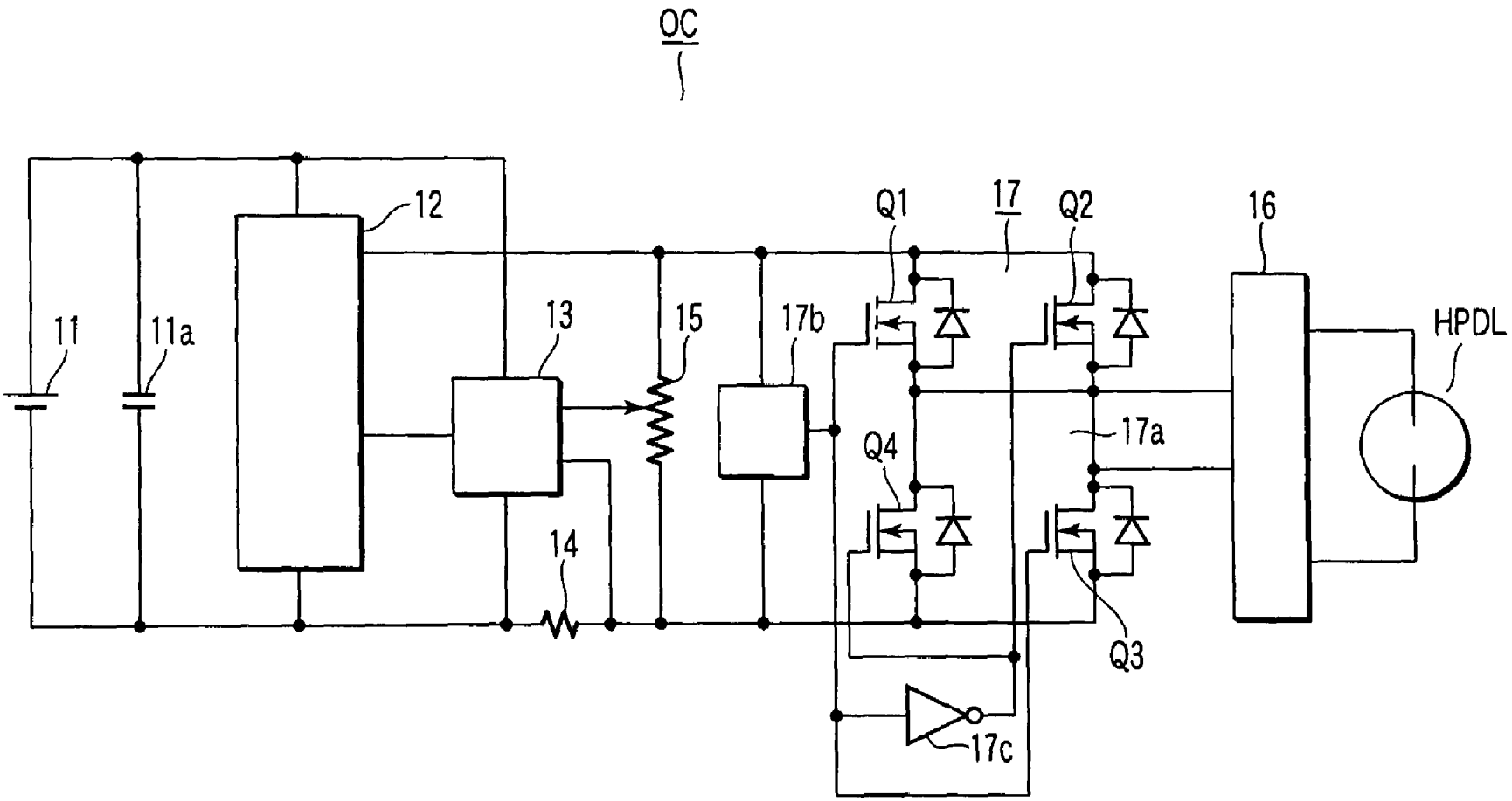
FIG. 5 is a circuit diagram illustrating the lighting circuit of the lighting device.

FIGS. 4 and 5 show a vehicle headlight to which the lighting device of the invention is applied. FIG. 4 is a perspective view of the headlight, taken from the back. FIG. 5 is a circuit diagram illustrating the lighting circuit of the lighting device. In FIG. 4, the vehicle headlight HL comprises a vehicle headlight main unit 21, two metal halide lamps HPDL and two lighting circuits OC.

The vehicle headlight main unit 21 comprises a front surface transmission panel 21*a*, reflectors 21*b* and 21*c*, lamp sockets 21*d* and attachment sections 21*e*, etc. The front surface lens 21*a* has a shape that accords with the corresponding outer surface portion of a vehicle, and includes predetermined optical means, such as a prism. The reflectors 21*b* and 21*c* are provided on the respective metal halide lamps HPDL to provide respective required light distribution characteristics. The lamp sockets 21*d* are connected to the respective output terminals of the lighting circuits OC, and provided in the respective metal caps B of the metal halide lamps HPDL. The attachment sections 21*e* are means for attaching the vehicle headlight main unit 21 to a predetermined position on a vehicle.

The metal halide lamp HPDL has the structure as shown in FIG. 1. The lamp sockets 21*d* are connected to the vehicle headlight main unit 21, fitted in the respective metal caps. Thus, the two metal halide lamps HPDL are mounted on the main unit 21, providing a four-lamp-type vehicle headlight structure. The respective light emission sections of the metal halide lamps HPDL are substantially located at the focal points of the reflectors 21*b* and 21*c*.

The two lighting circuits OC have a circuit structure described later. They are housed in respective metal containers 22 and used to light the respective metal halide lamps HPDL.

As shown in FIG. 4, each lighting circuit OC comprises a direct-current power supply 11, chopper 12, control means 13, lamp current detection means 14, lamp voltage detection means 15, igniter 16, metal halide lamp HPDL and full bridge inverter 17. When lighting the metal halide lamps HPDL, the lighting circuits OC firstly supply a direct current and then an alternating current.

The direct-current power supply 11 is means for supplying a direct current to the chopper 12, described later, and is formed of a battery or rectified-direct-current power supply. In the case of vehicles, a battery is generally used as the power supply 11. However, a rectified-direct-current power supply for rectifying an alternating current may be used. When necessary, an electrolytic condenser 11*a* is connected in parallel with the power supply 11 to perform smoothing.

The chopper 12 is a DC—DC converter circuit for converting a direct-current voltage into a preset direct-current voltage, and used to adjust the voltage at the metal halide lamp HPDL to a preset value via the full bridge inverter 17, described later. If the direct-current power supply voltage is low, a step-up chopper is used, while if it is high, a step-down chopper is used.

The control means 13 controls the chopper 12. Immediately after turn-on of the lamp, for example, the control means 13 supplies the metal halide lamp HPDL with a lamp current three times or more the rated lamp current, using the chopper 12 via the full bridge inverter 17. With lapse of time, the control means 13 gradually reduces the lamp current to the rated lamp current. Further, the control means 13 generates a constant power control signal to control the chopper 22 using a constant power, when detection signals corresponding to the lamp current and lamp voltage are fed back thereto. The control means 13 contains a microcomputer prestoring a temporal control pattern, which enables the above-mentioned control of supplying the metal halide lamp HPDL with the lamp current three times or more the rated lamp current, and gradually reducing the lamp current to the rated lamp current with time.

The lamp current detection means 14 is connected in series to the metal halide lamp HPDL via the full bridge inverter 17, and used to detect a current corresponding to the lamp current and input it to the control means 13.

The lamp voltage detection means 15 is connected in parallel to the metal halide lamp HPDL via the full bridge inverter 17, and used to detect a voltage corresponding to the lamp voltage and input it to the control means 13.

The igniter 16 is interposed between the full bridge inverter 17 and metal halide lamp HPDL and disposed to supply the metal halide lamp HPDL with a start pulse voltage of about 20 kV at the start of lighting.

The full bridge inverter 17 comprises a bridge circuit 17*a* formed of four MOSFETs Q1, Q2, Q3 and Q4, a gate drive circuit 17*b* for alternately switching the MOSFETs Q1, Q2, Q3 and Q4, and a polarity inverting circuit 17*c*. The full bridge inverter 17 converts a fixed polarity voltage from the chopper 12 into a low-frequency alternating polarity voltage of a rectangular waveform by utilizing the alternate switching, and applies it to the metal halide lamp HPDL to light it (low-frequency alternating-current lighting). During direct-current lighting immediately after ignition of the lamp, the MOSFETs Q1 and Q3, for example, of the bridge circuit 17*a* are kept on, and the MOSFETs Q2 and Q4 are kept off.

Using the lighting circuits OC constructed as above, firstly a direct current and then a low-frequency alternating current are supplied to the metal halide lamps HPDL, with the result that the lamps emit a predetermined luminous flux upon turn-on. Specifically, 25% of the rated flux is realized one second after ignition, which is required as a vehicle headlight, and 80% is realized four seconds after.

What is claimed is:

1. A metal halide lamp comprising:

a refractory, light-transmitting airtight container defining therein a discharge space with an internal volume of not more than 0.1 cc;

a pair of electrodes sealed in the airtight container, opposing each other with a distance of not more than 5 mm interposed therebetween; and a discharge medium sealed in the airtight container and including a metal halide material and a rare gas, the metal halide material including a first halide material and a second halide material, the first halide material containing a scandium (Sc) halide and a sodium (Na) halide, the second halide material containing at least one selected from the group consisting of an indium (In) halide and a zinc (Zn) halide, the discharge medium containing substantially no mercury, wherein a load on a wall of the airtight container in a stable state is not less than 50 W/cm$^2$; and $A/B \leqq 0.21$ where A represents an intensity of an impurity chromium (Cr) spectrum included in lighting spectra, and B represents an intensity of a scandium (Sc) spectrum included in the lighting spectra.

2. The metal halide lamp of claim 1, wherein said airtight container is configured to resist standard operation temperature of the lamp.

3. The metal halide lamp of claim 1, wherein the discharge space of said airtight container has an internal volume of not more than 0.05 cc.

4. The metal halide lamp of claim 1, wherein a load on a wall of the airtight container in a stable state is in a range of 55 W/cm$^2$ to 70 W/cm$^2$.

5. The metal halide lamp of claim 1, wherein said lighting spectra is the spectra of light emitted by said metal halide lamp.

6. The metal halide lamp of claim 1, wherein a discharge arc of said metal halide lamp is 0.85 mm or more.

7. A lighting device comprising:

a lighting device main unit;

the metal halide lamp specified in claim 1, the metal halide lamp being incorporated in the lighting device main unit; and a lighting device configured to light the metal halide lamp.

8. The lighting device of claim 7, wherein said airtight container is configured to resist standard operation temperature of the lamp.

9. The lighting device of claim 7, wherein the discharge space of said airtight container has an internal volume of not more than 0.05 cc.

10. The lighting device of claim 7, wherein a load on a wall of the airtight container in a stable state is in a range of 55 W/cm$^2$ to 70 W/cm$^2$.

11. The lighting device of claim 7, wherein said lighting spectra is the spectra of light emitted by said metal halide lamp.

12. The lighting device of claim 7, wherein a discharge arc of said metal halide lamp is 0.85 mm or more.

* * * * *